US006029323A

United States Patent [19]

Dickie et al.

[11] Patent Number: 6,029,323

[45] Date of Patent: Feb. 29, 2000

[54] POSITIVE LACE ZONE ISOLATION LOCK SYSTEM AND METHOD

[76] Inventors: Robert G. Dickie, 15 Valley Trail, Newmarket, Ontario, Canada, L3Y 4V8; Walter Karabin, 12 Cousin Drive, Aurora, Ontario, Canada, L4G 1B3

[21] Appl. No.: 09/094,903

[22] Filed: Jun. 15, 1998

[51] Int. Cl.[7] ..... A43C 7/00

[52] U.S. Cl. ..... 24/712.6; 24/712.1; 24/712.7

[58] Field of Search ..... 24/712.6, 712, 24/712.1, 712.7, 713, 713.6, 712.2, 712.3, 715.6, 712.4, 712.5, 713.7, 713.8

[56] References Cited

U.S. PATENT DOCUMENTS

| | | | |
|---|---|---|---|
| Re. 31,052 | 10/1982 | Adams | 24/712.5 |
| 514,284 | 2/1894 | Simmons | 24/712.6 |
| 515,844 | 3/1894 | Simmons | 24/712.6 |
| 574,484 | 1/1897 | Johnson | 24/712.6 |
| 819,884 | 5/1906 | Higgins | 24/712.6 |
| 1,132,785 | 3/1915 | McGinley | 24/712.7 |
| 3,290,745 | 12/1966 | Maxwell et al. | 24/712.6 |
| 4,291,439 | 9/1981 | Riti . | |
| 4,428,101 | 1/1984 | Harkavy . | |
| 4,514,882 | 5/1985 | Lavielle | 24/712.1 |
| 4,790,048 | 12/1988 | Arnt . | |
| 4,884,321 | 12/1989 | Holub . | |
| 5,022,127 | 6/1991 | Ang | 24/712.6 |
| 5,129,130 | 7/1992 | Lecouturier . | |
| 5,315,741 | 5/1994 | Dubberke . | |
| 5,353,483 | 10/1994 | Louviere . | |
| 5,566,474 | 10/1996 | Leick et al. . | |

FOREIGN PATENT DOCUMENTS

| | | | |
|---|---|---|---|
| 0495152 | 4/1930 | Germany | 24/712.6 |
| 0271364 | 1/1951 | Switzerland | 24/712.6 |

*Primary Examiner*—Victor N. Sakran
*Attorney, Agent, or Firm*—Cahn & Samuels, LLP

[57] ABSTRACT

A positive lace zone tension isolation device and method for use with laced footwear including a base, a opposed, pivotable cam for clamping interposed laces against the underlying base and isolating the selected lace tension against migration at that point.

14 Claims, 2 Drawing Sheets

POSITIVE LACE ZONE ISOLATION LOCK SYSTEM AND METHOD

TECHNICAL FIELD

The present invention is directed to improvements in laced footwear tie zone isolation and, particularly for high performance athletic and recreational footwear. The invention is for a positive footwear zone lacing lock for securing a footwear lace to the appropriate degree of tension selected by the user for selected lacing zones. The inventive locking element herein defines a convenient, reliable, reusable structure particularly, useful for skates, cross country ski boots, running shoes, mountain climbing boots, etc.

BACKGROUND OF THE INVENTION

The technology of athletic and recreational apparel and, notably, footwear has evolved dramatically over the past fifty years. Technical improvements are attributable to use of specially designed polymers, fasteners, liners, soles., etc. often which incorporate physiological/kinesiological performance enhancing features. Typically, such technological improvements first develop in the athletic fields and later migrate into the mass market. The rate of developments has increased, hastened by the continuing growth of commercialism in sports and entertainment. Regardless of the athletic/recreational discipline, virtually every aspect of footwear has been scrutinized to maximize performance and efficiency. For example, not long ago, basketball players wore Chuck Taylors. Today, one would be hard pressed to find a single pair in use. Likewise, in skating, steel blades and leather uppers have been replaced by titanium, composites, and polymers. Correspondingly, it would be imprudent for any athlete not to employ a device that measurably contributes, even if slight, to performance superiority. Although diminishing in substantial enhancement, technological improvements can provide an athlete with an edge, that small increment of enhanced performance permitting peak achievement.

A colorful illustration of athletic footwear development comes from Canada. The Iroquois developed ice skates using animal shinbones tied to footwear with leather thongs. These early skates would allow the user to glide over an icy surface, but without the same degree of confidence that a later evolved leather and steel skate provides. In the past two decades, skates (both ice and roller) have further evolved to incorporate specialize lightweight high strength plastic resins and composites secured to a titanium blade (in the case of ice-hockey skates). That combination produces desirable maximum strength and support while providing optimum weight reduction.

Referring to the constructions of professional level ice skates, typically they are constructed by first molding the boot liner to each of the skaters feet. These very personalized skates are then placed on the feet and the laces tied. In contrast to the significant improvements in skate construction, the art of lacing skates (or any high performance athletic shoe) has not changed over the centuries. Some lesser level footwear incorporate buckles, VELCRO®, and other lace-substituting securing expedients. However, it is rare at the highest levels of athletics or recreation, that the footwear is not laced. Lacing is an extremely personal activity where an athlete can control the tension and fit of the footwear to maximize performance, a function that can not be replaced by standardized straps and the like. Such standardized attachment devices do not allow an athlete to vary the lace tension along the various zones of the footwear. Not only do the general tension zones vary on the type of footwear, but each athlete has a unique zone tension preference.

Zoning is best defined as employing a specific influence in a given area within the laced area. In sport; professional or recreational, zoning is attempted in several ways. Simply, a lace can be tied with different tensions at certain areas to create zones secured with a knot. FIG. 1 illustrates an example of a zoned lace system on footwear. The upper zone U and lower zone L are tensioned by exerting different forces on the lace in these areas. The knot isolates the upper zone from the free zone F. The free zone is the portion of the lace that is not under tension.

Tensioning a lace in one zone can contribute to enhanced footwear functionality, while exerting a different tension on the same lace in another zone will achieve another specific result. Tension, however, tends toward randomness and migrates from the tighter to the looser. Thus, the differences in tensions between different zones diminish to create a loosening effect in the tighter zone, and conversely a tightening effect in the looser zone. Loosening of footwear is undesirable as it reduces comfort, and support which may lead to a loss of performance. The only solution to regain custom tension is to re-tie the lace or use multiple knots. Constant tying and re-tying of laces due to loosening can be frustrating and time consuming.

Once a lace is tied on a shoe or boot it is important to identify that in fact there are always at least two zones divided by the knot. The zone(s) below the knot, and the not so obvious free zone as shown in diagram 1—the lace above the knot. The tensionless lace in the free zone, above the knot, migrates toward the tensioned lace below the knot which allows the knot to loosen and come undone.

An athlete must employ technique when donning equipment. Indeed, it has been recognized that such technique is as important as the quality and fit of equipment itself. Some athletes prefer extremely tight laces in one zone of their footwear while other zones are only snug. Two players with the same equipment can have completely different strategies to lacing technique. When lacing skates, for example, lacing techniques as it relates to zoning vary not only from discipline to discipline, and skater to skater, but can even vary with the skater from activity to activity.

For instance, two hockey players with the same equipment will tie their skates with their own individual technique accomplishing the common result of ultimate comfort and support. One may increase the tension in the lower zone (lace area between the toes and the top of the instep) and in the upper zone (lace area between the top of the instep and the top of the ankle) by tightening the skate laces as tightly as possible in those zones. Another player, possibly a defensive player, who requires backwards skating and a corresponding range of motion might tie the skate laces as tight as possible in the lower zone and only snug in the upper zone. A figure skater, in contrast, generally leaves the lower zone snug for comfort and circulation. The upper zone, however, is faced as tight as possible for maximum support. Typically, a figure skater will double lace the boot hooks in an effort to retain the tension in the upper zone. While serving to preserve the lace tension, double lacing does not isolate the different zones. The greater exertion of a skater during skating, the more rapidly the tension migrates and the upper zone becomes less taut. It has been reported that 90% of the power delivered to the skate can be lost if the skate is loose.

Other athletic activities in which zoning is involved includes snowboarding (tautness in the upper zone that often requires retying). Runners, both sprinters and long-distance, have great concern with respect to zoning. Some runners employ a method to preserve optimized zoning which involves positively isolating zones. In an effort to overcome the zone-untensioning problem, some runners have developed methods used to retain the selected zone tension. One way to create positively isolated zones is to use more than one lace on the same foot as illustrated in FIG. 2. As illustrated, the main lace is tied conventionally along the length of the upper corresponding to the eyelets E and a second and/or third lace (DL) is tied at the top and bottom of over the upper zone U. Although effective in isolating tension zones, this method requires tying extra knots K, and may result in some modification of the footwear such as cuffing and trimming one end to obtain the correct length. Clearly, a two/multi- lace system is an inefficient solution to the zone tension retention problem.

The composition of the laces themselves, contribute to the degree and rate of zone tension migration. The most effective material for zoning is a cotton lace due to the friction between the lace and the eyelet helping to retain tension in the zones. However, cotton, being biodegradable, does not respond favorably to moisture. Polyester lacing, although having moisture resistant capacity and being capable of being tied with more tension than cotton does not frictionally engage with the shoe eyelet as well as cotton. This is due to the fact that polyester causes less friction at the eyelet compared to cotton. Polyester laces are smooth and slide easily through eyelets. Therefore, although the lace is tighter, the lace is not able to retain zone tensioning. Migration of tension occurs rapidly with polyester laces.

One technique has been reported to combine the advantages of both lace types. Athletes can apply wax to cotton laces which, during lacing, allow the lace to slide with less friction through the eyelet. Friction between the lace and the eyelet causes the wax to melt reducing friction at the eyelet. Once laced, the wax at the eyelet cools and becomes sticky. This stickiness slows tension migration between zones.

The foregoing underscores the problems associated with conventional shoe/boot laces and methods, particularly in high performance athletic endeavors Furthermore, the foregoing highlights a need for a tension zone adjunct for lace footwear to reduce the need for lacing technique compromises.

SUMMARY OF THE INVENTION

It is therefore an object of the present invention to provide a lace adjunct and method that overcomes shortcomings and problems of the prior art.

It is another object of the invention to provide a means and method for improved positive zone isolation will eliminate migration of tension between zones.

It is another object of the invention to provide an improved locking device for lace zone isolation that is adaptable for use with any type of laced structures and particularly laced footwear.

It is another object of the invention to provide an improved tension-locking adjunct that preserves differential tightening of a lace relative to selected zones.

Still another object of the present invention to provide a lace locking device that is lightweight and conveniently used.

A further object of this invention is to provide a simple, economical structure and method for positive lace zoning which provides adequate strength, structural integrity, and durability for use in the most demanding of footwear environments.

A further object of this invention is to provide positive lace tension zone isolation adjunct be conveniently and efficiently used.

These and other objects are satisfied by a laced article lace securing member, featuring a base, a clamping means juxtaposable in a first non-clamping position over said base and a second confronting clamping position positionally securing said lace over said base, said clamping means being movable between said first and second positions.

Further objects of the present invention are satisfied by a method for lacing articles having a lace, a series of lace receiving eyelets, said eyelets being disposed in pairs and in two generally parallel rows, the method comprising the steps of:

placing a lace tension locking device including a base and confronting clamp attached thereto movable between a lace releasing state and a lace clamping state, said lace tension locking device being placed between said rows of eyelets and between two pairs of eyelets;

passing the lace between said base and said confronting clamp;

adjusting the lace between said eyelets to a selected tension; and moving said clamp to the lace clamping state.

The instant invention is intended primarily to help maintain support in footwear by eliminating tension migration between zones which occurs when laces loosen in an area of support. The invention serves to reduce the number of times laces need re-tying to maintain positively zoned lacing to thereby permit an athlete/recreationalist to focus more clearly on the activity. For example, a marathon runner will no longer deal with frustration of undone laces during competition thus being able to enjoy a level of reliance and comfort because positive tension zone control is tuned for custom fit of the particular athlete.

The invention herein is a non-obstructing adjunct for laced articles that rely on lace zoning provide to positionally secure the article and to maximize comfort and control. The preferred structure of the invention is molded, weighs less than an average pair of laces and dimensionally corresponds to a small postage stamp. Functionally, the small invention provides a significant function as a lace tension zone preserving expedient particularly intended to clamp onto and positionally lock laces where they cross to positively isolate the lace tension of one zone from others. As employed, the preferred practice of the invention stabilizes the tension of a particular lace zone by clamping at the cross of the laces relying on camming action to compress the laces. In a preferred structural embodiment of the invention, the cam may incorporate a serpentine path of lock teeth for engaging the underlying lace to enhance frictional engagement and minimize movement thereof.

When properly used, the invention permits the user to tie the lace conventionally and to select the lace crossover point(s) where tension zone division is desired. As descried below, the invention contemplates snapping a locking cam tab onto the lace crossover positioned between the cam and the base to positionally lock the lace. When locked, the lock will prevent lace tension from migrating thereby preserving lace tension between zones, e.g., positively locking lace zone tension. Release of the device involves simply unlatching the tab and either removing the device from the laces or allowing it to remain on the footwear in its unactuated mode.

The word "substantially" when used with an adjective or adverb is intended to enhance the scope of the particular characteristic; e.g. substantially planar is intended to mean planar, nearly planar and/or exhibiting characteristics associated with a planar element.

Given the following enabling description of the drawings, the invention particularly suited for use in connection with laced articles should become evident to a person of ordinary skill in the art.

DETAILED DESCRIPTION OF THE PREFERRED EMBODIMENT

Figure 4:
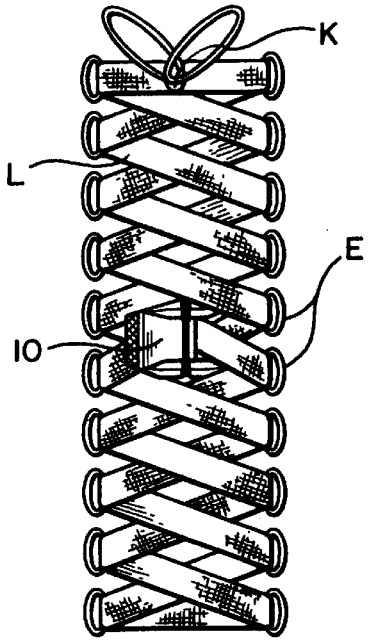
FIG. 4 is a top assembly view of the embodiment illustrated in FIG. 3.
Figure 2:
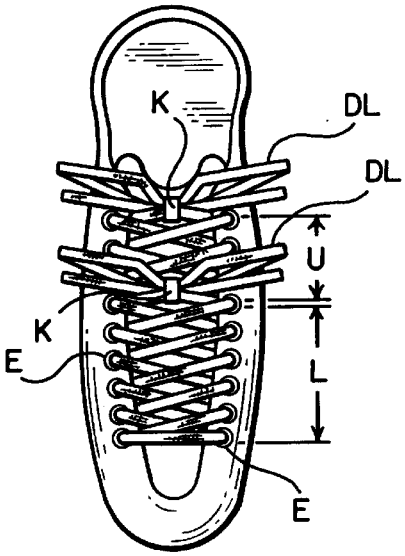
FIG. 2 is top view of a prior art double lace zone tension arrangement.
Figure 3:
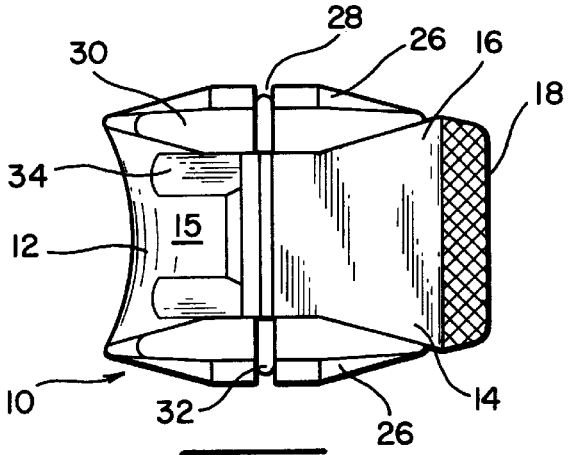
FIG. 3 is a top view of an embodiment the invention.
Figure 5:
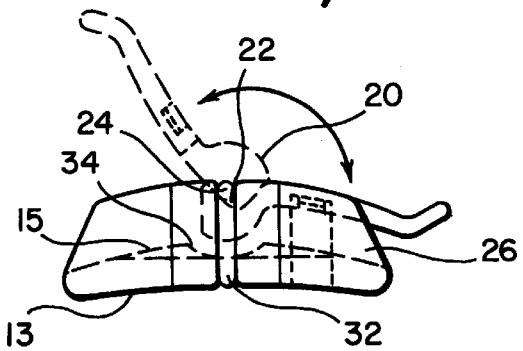
FIG. 5 is partial cutaway side view of the embodiment illustrated in FIG. 3.
Figure 6:
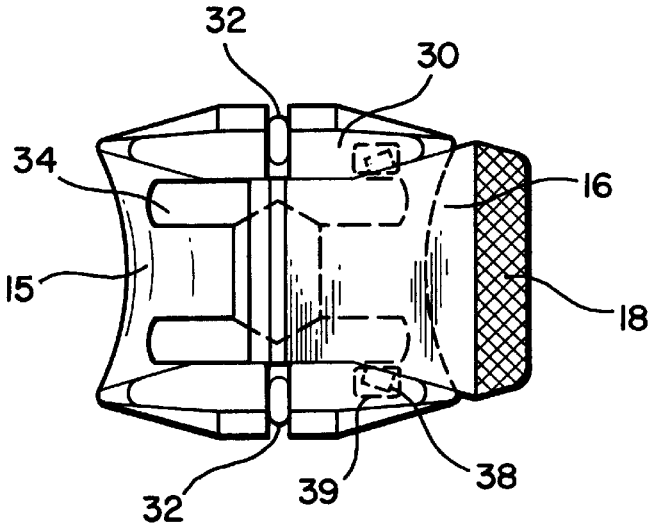
FIG. 6 is a top view of the embodiment the invention illustrated in FIG. 4.
Figure 7:
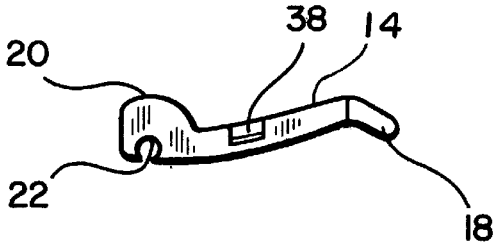
FIG. 7 is a side view of the tab cam of the embodiment illustrated in FIG. 4.
Figure 8:
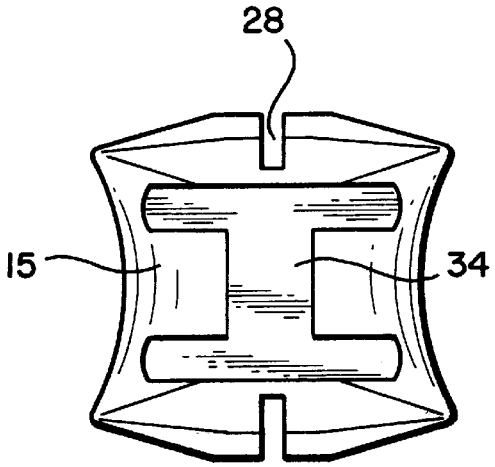
FIG. 8 is top view of the base of the embodiment illustrated in FIG. 4.

FIGS. 3–5 depict an embodiment of the inventive lace tension lock 10 according to this invention. The lock 10 includes a base having a substantially planar lower face 13 and a contoured upper surface 15. A cam tab 14 including the substantially planar tongue 16 terminating with knurled finger grip 18 at one end and narrowing to a camming body 20 at the other end and is disposed above and pivotally attached to the base. The cam tab 14 includes a transverse groove 22 dimensioned to retain a stainless steel C-ring 24 which is mounted to the base 12 at the approximate midpoint of a pair of opposed, upwardly projecting base walls 26. The base walls 26 shield and protect the interior of the lock 10 from external forces. Each of the base walls 26 include a C-ring receiving slot 28 and an interiorly angled guide wall 30 which projects a select distance inwardly at an angle to both guide laces disposed between the walls and to accommodate the width of the planar tongue extending between the camming body 20 and the finger grip 18.

The slots 28 and the side walls 26 secure the C-ring 32 to the base 12. The C-Ring 32 snaps into the groove 22 to positively engage the C-ring thereby providing pivotal attachment of the cam tab 14 at a select height above the upper surface 15 to positionally secure the camming body 20 at a confronting but spaced-apart engagable relation with the upper surface 15. As a result of the above described structure and interrelationship thereof, it should be apparent that the forces acting on the locking cam tab 14 are opposite each other. Preferably, the upper surface 15 of the base 12 includes an irregular aspect (as illustrated, grooved) to assist in maintaining the lace crossover in a fixed position relative to the tension lock 10 and to contribute to the lace tension retaining function of the invention. The illustrated lace tension retaining feature comprises generally H-shaped trough 34, which is formed on the upper surface 15 to provide a lace recess of a depth selected to accommodate both the camming body 20 and an interposed lace. Additional lace-tension lock friction enhancing adjuncts may also be incorporated. For example, the entirety or primary contact areas of the surface 15 may include irregularities such as serrations or bumps. To provide an increased level of user confidence and to minimize undesired disengagement, the tension lock 10 may include a tab catch to secure the tab in the lace clamping position beyond the mere camming forces. The illustrated catch member is formed by a cooperating tab 38 projecting from the side of the tab 14 and a dimensionally corresponding recess 39 formed in slanted interior side walls 30. The mechanical, detenting engagement of the tab in the recess assists to positionally secure the cam tab 14 relative to the base 12.

It should be apparent from the foregoing that the tension lock 10 should be composed of rugged, strong, durable materials to withstand the harshest of apparel environments. By so fabricating the tension lock 10, regardless of the degree of environmental aggressiveness (temperature, shock, moisture, etc.) the zone isolation functionality is preserved. Preferably, the base 12 and tab cam 14 are injection molded from a synthetic polymer possessing resiliency and high tensile strength. For example, when used in a hockey environment, clearly, the material must be capable of withstanding high impact conditions in a wide range of ambient temperatures. Because the C-ring clamp 32 serves to retain the tension lock together, preferably, it is formed of stainless steel to maximize holding power and full functionality in aggressive situations. It should be readily appreciated that the several components or the entire structure can be composed of any of metals, ceramics, or synthetic polymer resins.

Figure 1:
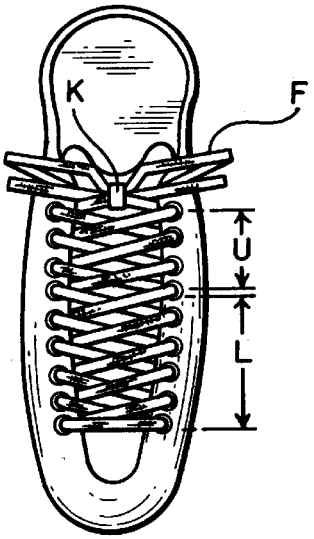
FIG. 1 is a top view of a prior art tied laced athletic shoe also illustrating typical tying zones.

In application, the tension lock 10 may be permanently attached to the laced article (e.g., footwear, boxing gloves, corset, etc.) or may be an independent device. Even if not affixed to the laced article, the presence of the threaded, interposed laces will retain the lock in the article safely. In keeping with the preferred embodiment, the lock 10 may include an attachment member for mounting on the tongue of the shoe at a location corresponding to a zone transition (See FIG. 1). As illustrated, the laces are passed through the gap between the cam tab 14 and the base 12. The laces are urged toward the center of the upper surface 15 by the interior guide walls 30. During the lace tightening and tying process, the user selects the desired lace tension in a zone and pushes on the grip 18 to pivot the tab 14 about the ring 24 whereupon the camming body 20 compresses the lace against the upper surface 15 of the base 12. As the cam body 20 compresses against the interposed lace, it urges the lace into the positioning trough 34. When pivoted to the locked position, the grip 18 is further pressed to cause the tabs 38 to snap into the recesses 39. To reverse the process, the user pulls on the grip 18 to release the detenting tab and overcome the camming to unclasp the lace.

The above-described inventive device can be adapted and employed in a wide variety of recreational and athletic activities such as hockey, figure skating, in-line skating, snowboarding, bicycling, running, etc. where convenient positive lace tension zoning is desired. Consequently, the design variations are essentially unlimited so long as the design provides for lace tension zoning.

Given the foregoing, variations and modifications to the invention should now be apparent to a person having ordinary skill in the art. These variations and modifications are intended to fall within the scope and spirit of the invention as defined by the following claims.

We claim:

1. A laced article lace securing member for maintaining selected tension using at least one clamping member, comprising:

a base, said base having an upper surface that is contoured and defining a lace passage thereon and two opposed and upstanding spaced apart walls projecting above the base where a clamping means is mounted above said base and between said walls;

said clamping means movably mounted to said lace for clamping onto said lace, said clamping means being juxtaposable and pivotally secured in a first non-clamping position over said base providing a gap between said clamping means and said upper surface of said base of sufficient dimensions to accommodate crossover of the lace and lace receiving troughs providing a friction engaging adjunct to minimize movement of the lace relative to the zone tension lock when in a lace locking second confronting clamping position over said base, said clamping means being movable between said first and second positions where said base is secured on said lace at a crossover thereof.

2. The lace securing member of claim 1 where said clamping means is a pivotable cam for selectively tensioning the lace.

3. The lace securing member of claim 2 where said cam pivots between a lace engaging tension locking position and a tension releasing unlocked position.

4. The lace securing member of claim 3 where said cam is formed on a cantilevered buckle element and said base is generally rectangular and planar.

5. The lace securing member of claim 3 where said troughs are H-Shaped and provide a serpentine path for the lace.

6. The lace securing member of claim 3 further comprising a catch associated with at least one of said walls to frictionally engage said cam lever when in said lace locking state.

7. The lace securing member of claim 1 where said base and clamping means are composed from a material selected from the group metal, ceramic, synthetic polymer resins.

8. A laced footwear zone tension lock for maintaining selected lace tension using at least one tension lock, comprising:

a substantially planar base including an upper surface having at least lace receiving trough providing a friction engaging adjunct formed thereon, two opposed and upstanding spaced apart walls projecting above the base, and a cam lever mounted above said base and between said walls capable of pivoting between a first disengaged state and a second lace locking state, where said cam lever when in said first disengaged state lace is disposed above said base at a height greater than the height of a two thicknesses of said lace and when in said second lace locking state said cam lever is in a confronting relationship with said base and separated therefrom by a height of less than two thicknesses of said lace to prevent movement of the lace relative to said base and cam lever;

where the tension lock is secured to said lace at a crossover and said cam lever permits said lace crossover to pass between it and the base in said first disengaged state and clampingly engages said lace crossover against said trough in said second lace locking state.

9. The laced footwear zone tension lock of claim 8 where said trough is H-Shaped.

10. The laced footwear zone tension lock of claim 8 further comprising a catch element associated with at least one of said walls to frictionally engage said cam lever when in said lace locking state.

11. The laced footwear zone tension lock of claim 8 where said base is composed from a material selected from the group metal, ceramic, synthetic polymer resins.

12. The laced footwear zone tension lock of claim 8 further comprising means for mounting said lock on the footwear.

13. The laced footwear zone tension lock of claim 8 where said trough friction engaging adjunct comprises serrations extending between said walls.

14. The laces footwear zone tension lock of claim 8 where said lace receiving trough provides a serpentine path for the lace to minimize movement of the lace relative to the zone tension lock when in the lace locking state.

* * * * *